United States Patent [19]

Slaughter

[11] Patent Number: 4,741,164

[45] Date of Patent: May 3, 1988

[54] COMBUSTION ENGINE HAVING FUEL CUT-OFF AT IDLE SPEED AND COMPRESSED AIR STARTING AND METHOD OF OPERATION

[76] Inventor: Eldon E. Slaughter, 9 Sachem Rd., Greenwich, Conn. 06830

[21] Appl. No.: 45,153

[22] Filed: Apr. 30, 1987

Related U.S. Application Data

[63] Continuation of Ser. No. 787,677, Oct. 15, 1985, abandoned.

[51] Int. Cl.[4] ..... F02D 17/04; F02N 9/04

[52] U.S. Cl. ..... 60/627; 123/198 DB; 123/237

[58] Field of Search ..... 60/625, 626, 627, 39.6, 60/39.63; 123/179 F, 198 DB, 198 F, 237, 248

[56] References Cited

U.S. PATENT DOCUMENTS

| | | | |
|---|---|---|---|
| 900,668 | 10/1908 | Cottrell et al. . | |
| 948,248 | 2/1910 | Reaugh | 60/627 |
| 1,091,132 | 3/1914 | Harford | 123/237 X |
| 1,101,794 | 6/1914 | Friend | 123/237 |
| 1,140,723 | 5/1915 | Eyck | 60/627 |
| 1,153,169 | 9/1915 | Miller | 123/237 |
| 1,180,099 | 4/1916 | Zuendt | 123/248 X |
| 1,222,475 | 4/1917 | Sears . | |
| 1,281,621 | 10/1918 | Marion | 123/237 |
| 1,369,070 | 2/1921 | Williams et al. | 123/248 X |
| 1,607,505 | 11/1926 | Bentley . | |
| 1,674,449 | 6/1928 | Riggs . | |
| 2,131,216 | 9/1938 | Brooke . | |
| 2,250,484 | 7/1941 | Jutting | 123/248 X |
| 2,938,505 | 5/1960 | Quartier . | |
| 3,958,900 | 5/1976 | Ueno | 123/198 F X |
| 4,106,472 | 8/1978 | Rusk . | |
| 4,137,890 | 2/1979 | Wohl | 123/248 X |
| 4,149,370 | 4/1979 | Vargas | 60/39.6 |
| 4,178,900 | 12/1979 | Larsen . | |
| 4,192,279 | 3/1980 | Maisch et al. | 123/198 DB X |
| 4,211,083 | 7/1980 | Ueno | 60/626 |
| 4,448,161 | 5/1984 | Tseng | 123/237 |
| 4,453,506 | 6/1984 | Ueda et al. | 123/198 DB X |
| 4,494,497 | 1/1985 | Uchida et al. | 123/198 DB X |
| 4,653,269 | 3/1987 | Johnson | 60/627 X |

FOREIGN PATENT DOCUMENTS

| | | | |
|---|---|---|---|
| 10206 | of 1914 | United Kingdom | 60/627 |

*Primary Examiner*—Michael Koczo

*Attorney, Agent, or Firm*—Litman, McMahon & Brown

[57] ABSTRACT

A rotary internal combustion engine which includes a lobed combustion rotor and a similar compression rotor on a common shaft and firing chambers external to the combustion and compression cavities. The compression rotor compresses excess amounts of air during normal operation which is stored in a tank. During operation, the rotational speed of the engine shaft and the position of an accelerator are sensed. The engine may be run in a non-idle mode by inhibiting the flow of fuel and air to the firing chambers and inhibiting the spark plugs when an idle speed accelerator position and an idle engine speed are sensed, to shut down the engine. When the accelerator is afterwards pressed, the engine is restarted by valving stored compressed air to the combustion cavity to cause the combustion rotor to turn.

11 Claims, 4 Drawing Sheets

Fig. 1.
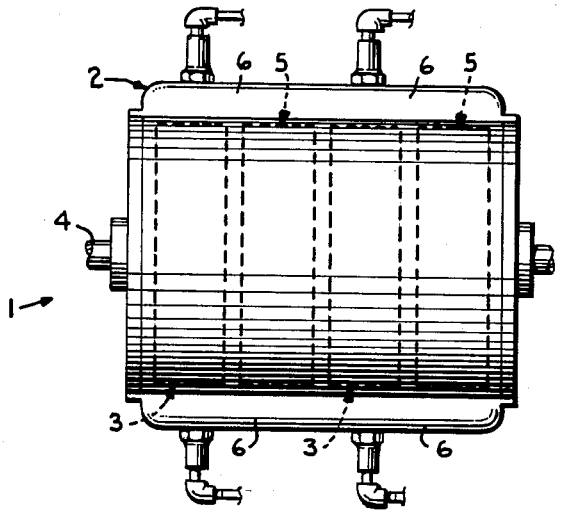
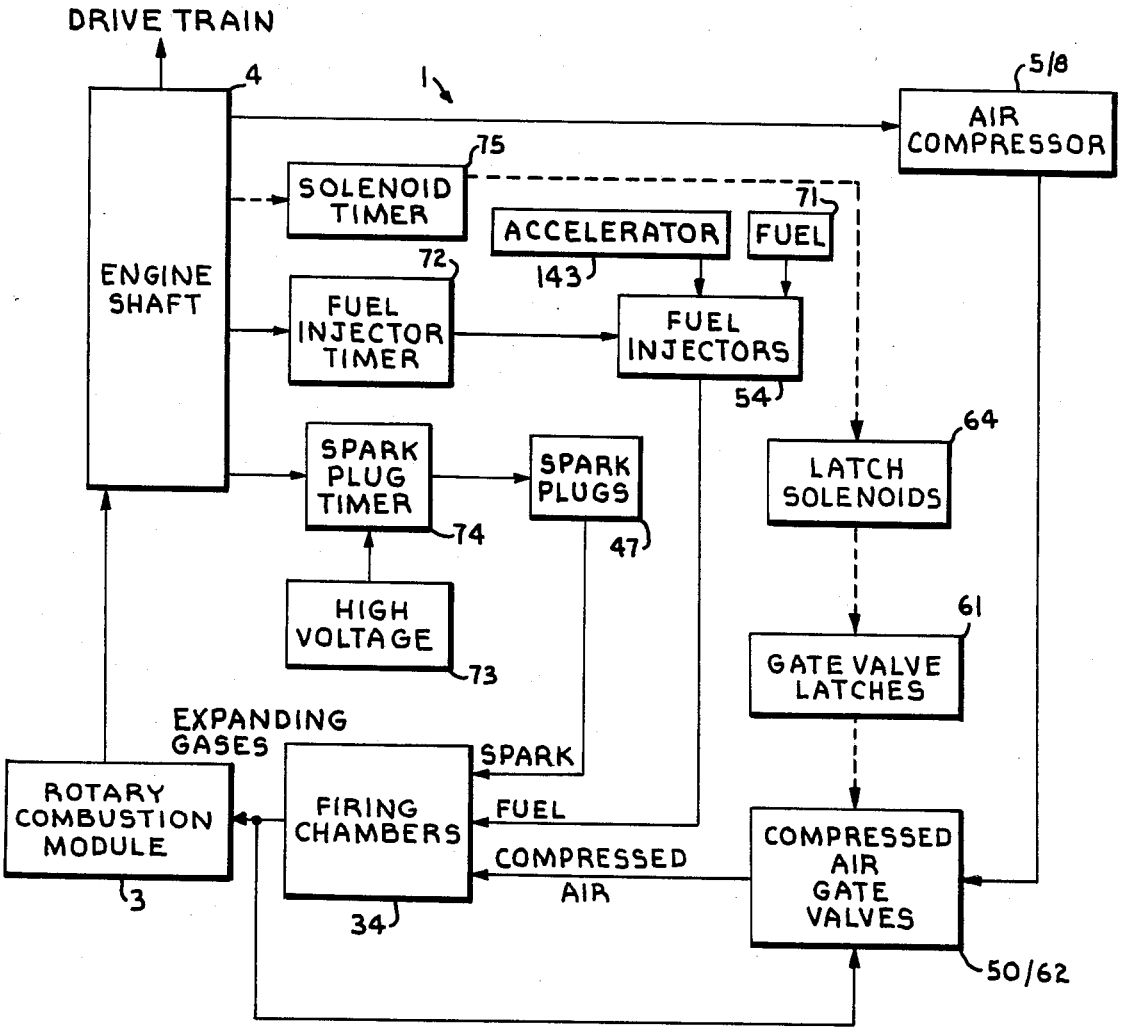
Fig. 2.

COMBUSTION ENGINE HAVING FUEL CUT-OFF AT IDLE SPEED AND COMPRESSED AIR STARTING AND METHOD OF OPERATION

CROSS REFERENCE TO RELATED APPLICATION

The present application is a continuation of Ser. No. 787,677 filed Oct. 15, 1985 entitled External Compression Rotary Engine, now abandoned.

FIELD OF THE INVENTION

The present invention relates to rotary internal combustion engines and, more particularly, to such an engine employing an improved combustor device with pressure actuated valves along with air compression external to the engine combustion chamber.

BACKGROUND OF THE INVENTION

Conventional reciprocating piston internal combustion engines are very complex mechanisms employing a great many parts which are subject to wear and which contribute to losses of efficiency due to friction. Additional energy is lost due to the necessity of reversing the direction of linear motion of the pistons and the conversion of the linear motion to rotary motion. The reciprocating motion of the pistons also creates vibrations which contributes to the failure of components of such engines and structures to which they are attached. In spite of the problems and inefficiencies of reciprocating piston engines, such engines have been very successful and form the majority of prime movers for ground transportation and many other uses.

Throughout the twentieth century, attempts have been made to develop entirely rotary internal combustion engines to overcome the inherent problems of linear piston engines. Few attempts have been successful. While many such engines appeared to have theoretical potential, it has been difficult or impossible to construct practical working models of such engines. The only well-known rotary engines which have achieved practical success are gas turbine engines and the Wankel rotary internal combustion engine.

In general, gas turbine engines have been applied most successfully to aircraft propulsion as fairly large engines. While a few small engines have been built and tested in passenger car size ground vehicles, the disadvantages of small gas turbine engines have outweighed the advantages. Maintenance of such engines is more expensive than for a comparable size piston engine. Additionally, the engine power relative to engine speed range is narrower for gas turbine engines whereby ground vehicles would require more complex and thus more expensive transmissions than are needed for piston engine driven cars.

The Wankel rotary engine, in contrast, has been applied fairly successfully to smaller ground vehicles such as automobiles and motorcycles, although not on a great scale and not without problems. Initially, there was a problem with excessive wear of rotor apex seals. Such problems have been overcome for the most part by the use of improved materials and manufacturing techniques. While the major component of motion of the Wankel rotor is, as its name implies, rotary, there is additionally a reciprocating component since the housing cavity in axial cross section is elongated rather than circularly cylindrical. The reciprocating component of rotor motion is a consequence of the geometry of the rotor and housing, the manner of gearing the rotor to the engine shaft, and the manner in which the fuel-air mixture is compressed and exhausted after combustion. This causes some loss of efficiency since energy must be expended in accelerating and decelerating the rotor through its linear components of motion.

SUMMARY OF THE INVENTION

The present invention provides a rotary internal combustion engine employing air compression which occurs external to the combustion cavity of the engine. The compressed air is communicated through a pressure actuated valve to a firing chamber wherein the compressed air is mixed with fuel from a fuel injector and ignited by a spark plug. The firing chamber communicates the expanding combustion gases to the combustion cavity to cause rotation of the rotor through a hinged firing chamber valve which, upon opening, sealingly engages the peripheral surface of the rotor and divides a portion of the combustion cavity into an expansion chamber on one side of the firing chamber valve and an exhaust chamber on the other side. The external compression of air and other structural and mechanical details of the engine allow the combustion cavity to be cylindrical such that the rotor may simply be keyed to the engine shaft and move in a strictly rotary manner with no linear reciprocating component.

The combustion rotor of an engine embodying the present invention has at least two lobes which sealingly contact the peripheral cylindrical surface of the combustion cavity. The rotor is configured such that the remaining volume of the combustion cavity not occupied by the rotor are substantially crescent shaped. It is these crescent shaped volumes which are divided into expansion chambers and exhaust chambers by the firing chamber valves.

The compressed air gate valve which controls the entry of compressed air into a firing chamber is resiliently urged to close the air gate. The gate valve is opened to allow compressed air inflow by the level of pressure within the firing chamber. When the fuel-air mixture is ignited, the combustion pressure causes the air gate valve to positively seat thereby closing the gate and preventing back pressure from entering the compressor. In some cases, it might be desirable to lock the gate valve in the seated position and release same by a timed solenoid operated latch. The firing chamber valve is also resiliently urged to close communication between the firing chamber and the combustion cavity and is opened by combustion pressure. The position of the firing chamber valve is controlled by the pressure within the firing chamber and the position of the lobes on the combustion rotor.

In one embodiment of the engine, the air compressor is a rotary compressor employing a lobed rotor similar in many respects to the combustion rotor and keyed to the engine shaft with the combustion rotor and cavity forming a combustion module and the compression rotor and cavity forming a compression module. The compression module may be sized to feed an additional combustion module of the engine. The combustion and compression modules may be enclosed in a common housing with partitions therebetween.

The various embodiments of the rotary engine may employ a compressed air reservoir tank along with suitable valves which allow starting of the engine by the injection of compressed air, without fuel initially, into the combustion cavities to cause the rotor to rotate. The compressed air start capability is preferably augmented by a conventional electrical starter in case air pressure is exhausted before the engine can be started. In a high fuel efficiency embodiment of the engine, the engine is not normally idled. Instead, when the accelerator is fully released, the fuel supply is cut off whereby the rotors freewheel to a stop. When pressure is reapplied to the accelerator, the engine is restarted by compressed air injection in combination with electric motor rotation of the engine as needed.

OBJECTS OF THE INVENTION

The principal objects of the present invention are: to provide an improved internal combustion engine; to provide an engine of greatly improved efficiency, higher output power to weight ratio, and improved torque, capabilities; to provide such an engine which avoids the reciprocation of relatively large masses therein and the conversion of the linear movement to rotary movement to improve fuel efficiency and reduce vibrations; to provide such an engine having fewer parts and which does not require the complex type of valve mechanisms which are required in conventional reciprocating engines; to provide a rotary engine including a lobed rotor positioned in a combustion module cavity and an external air compressor driven by the combustion module rotor; to provide an embodiment of such an engine including a compression module having a lobed compression rotor on the same shaft as the combustion rotor, the compressor communicating compressed air to the combustion module for mixture with a fuel to rotate the combustion rotor upon the ignition of the mixture; to provide such an engine employing a multiplicity of combustion modules and at least one compression module; to provide such an engine including an improved combustor device having a firing chamber communicating with the combustion module, having the gap of a spark plug and a fuel injector therein, and having a gate valve controlling the flow of compressed air into the firing chamber in cooperation with the pressure generated upon the ignition of a fuel-air mixture in the firing chamber; to provide an embodiment of such an engine wherein the gate valve is latched in a seated position and released by a solenoid actuated latch which is timed by the rotation of the combustion rotor; to provide such an engine including a hinged firing chamber valve which is allowed to open after the combustion of the fuel-air mixture by the lobe of the combustion rotor and which seals against the periphery of the rotor to divide portions of the combustion cavity into an expansion chamber on one side of the valve and an exhaust chamber on the other side; to provide such an engine including a compressed air reservoir tank and suitable valves whereby the engine may be started by the injection of compressed air into the combustion modules to rotate the rotor; and to provide such a rotary engine which is economical to manufacture, efficient and durable in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a side elevational view of an external compression rotary engine according to the present invention.

FIG. 2 is a block diagram illustrating the operation of the rotary engine.

DETAILED DESCRIPTION OF THE PREFERRED EMBODIMENT

Figure 3:
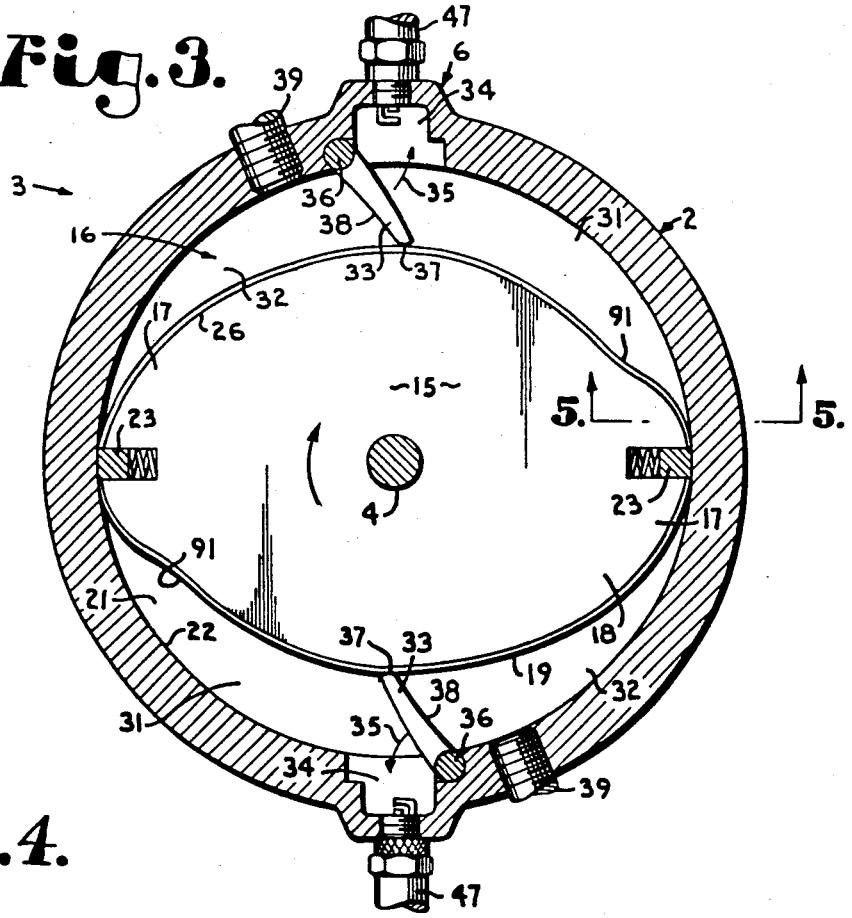
FIG. 3 is an enlarged transverse sectional view of a combustion module of the rotary engine.
Figure 4:
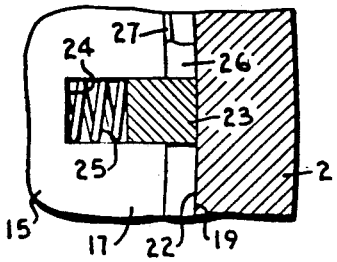
FIG. 4 is a greatly enlarged transverse sectional view of a portion of the combustion module and illustrates further details of one of the rotor face seals.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates an external compression rotary engine embodying the present invention. The engine 1 generally includes an engine housing 2 which encloses at least one rotary combustion module 3 operative to cause the rotation of a engine shaft 4. In a preferred embodiment of the engine 1, at least one compression module 5 is also enclosed by the housing 2 and is operated by the rotation of the shaft 4 to compress air for mixture with a fuel. Ignition of the fuel-air mixture in combustor units 6 associated with the combustion modules 3 generates combustion gases the pressure of which causes rotation of the engine shaft 4.

The term "external compression" should be understood to mean that air is compressed external to combustion cavities within the combustion module 3 rather than necessarily external to the engine housing 2. Therefore, the compression module 5 may be replaced by an air compressor unit 8 which is external to the engine housing 2 but is driven by the engine shaft 4 as through a belt or gear arrangement (not shown) or by direct connection.

Referring to FIG. 3, the engine shaft 4 is rotatably mounted through the housing 2 as in bearing units (not shown). Each combustion unit 3 generally includes a volume element or lobed combustion rotor 15 positioned in a variable working volume chamber or cylindrical combustion cavity 16 in the housing 2 and keyed or otherwise non-rotatably attached to the engine shaft 4. The illustrated rotor 15 has two lobes 17 on opposite sides of the shaft 4. The rotor 15 has flat end faces or base surfaces 18 on opposite sides thereof and a smooth and continuous peripheral surface 19. The combustion cavity 16 has opposite base surfaces 21 and a cylindrical peripheral surface 22.

Gas sealing between the lobes 17 of the rotor 15 and the cylindrical surface 22 of the combustion cavity 16 is maintained by rotor apex seals 23 positioned in apex seal grooves 24 extending across the surface 19 of the lobes 17. The seals 23 are resiliently urged toward the surface 22 by apex seal springs 25. Sealing between the end faces 18 of the illustrated rotor 15 and the base surfaces 21 of the cavity 16 is maintained by end face seals 26 positioned in end face seal grooves 27. The seals 26 extend from apex seal to apex seal and from the grooves 27 to flush with the peripheral surface 19 of the rotor on both faces 18 thereof. Alternatively, other means for sealing between the rotor 15 and the surfaces of the combustion cavity 16 are foreseen.

The rotor 15 is of a somewhat distorted elliptical shape in radial cross-section and defines crescent or C-shaped chambers 29 (see FIG. 7) between the cylindrical surface 22 of the cavity 16 and the peripheral surface 19 of the rotor. Each of the chambers 29 is operationally divided into an expansion chamber 31 and an exhaust chamber 32 by a hinged firing chamber valve 33. The firing chamber valves 33 control the communication of gases between firing chambers 34 of the combustor units 6 and the combustion cavity 16. The firing chamber valves 33 are resiliently urged to closed positions by firing chamber valve springs 35 (represented by arrows 35 in the figures) engaged between hinge shafts 36 of the valves 33 and the housing 2. Each firing chamber valve 33 has an outer edge 37 which sealingly contacts the peripheral surface 19 of the rotor 15 when the valve 33 is fully opened. A surface 38 of each valve 33 on the combustion cavity side thereof is cylindrical and of the same radius as the combustion cavity 16 to form a continuation thereof when the valve 33 is closed. Each of the exhaust chambers 32 communicates with an exhaust port 39 for exhausting expanded combustion gases from the combustion cavity 16. The exhaust ports 39 must be large enough to prevent substantial back pressure on the rotor 15 to avoid losses in efficiency.

Figure 11:
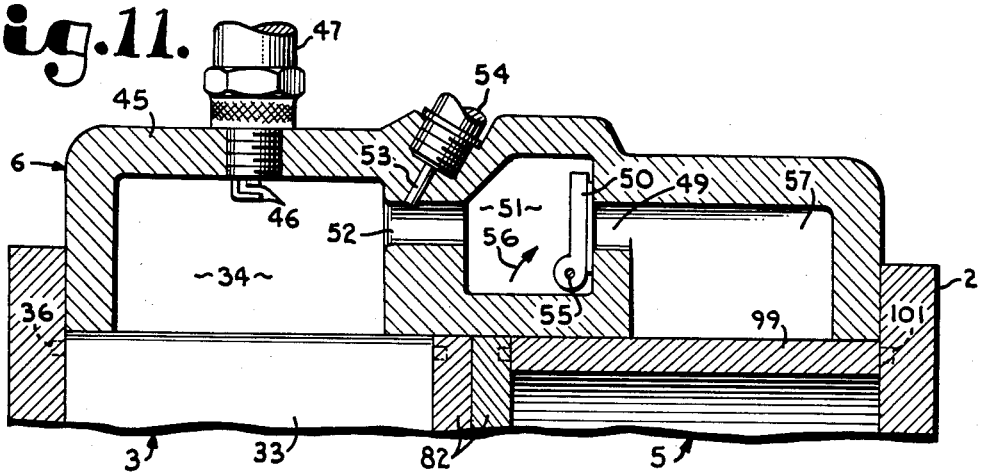
FIG. 11 is a greatly enlarged sectional view through a combustor unit of the rotary engine of the present invention.

The combustor units 6 are operative to form a mixture of fuel and compressed air, ignite the mixture, and communicate the combustion gases to the combustion cavity 16 to cause rotation of the rotor 15 and thus the engine shaft 4. Referring to FIG. 11, each combustor unit 6 includes a combustor unit wall 45 which forms the firing chamber 34 thereof. The wall 45 may be integral with the housing 2 or may be a separate structure which is bolted or otherwise attached to the housing 2 along with a sealing gasket (not shown) as needed.

The firing chamber 34 has the electrodes 46 of an ignitor such as a spark plug 47 positioned therein for igniting the fuel-air mixture therein. Th electrodes 46 are preferably positioned to cause the most efficient combustion of the mixture. Compressed air is received into the firing chamber 34 from a compression module 5 or compressor 8 through a compressed air gate 49 as controlled by the position of a compressed air gate valve 50. A gate valve chamber 51 is formed within the combustor unit 6 to provide sufficient room for the gate valve 50 to move to a fully open position. The illustrated combustor unit 6 includes an inject passage 52 communicating between the valve chamber 51 and the firing chamber 34. A nozzle 53 of a fuel injector 54 is positioned in the inject passage 52 and delivers fuel into the firing chamber 34 therethrough. The constriction provided by the inject passage 52 accelerates the air flowing therethrough to promote the dispersion of the fuel mist into the air flowing into the firing chamber.

The illustrated air gate valve 50 is a swinging or hinged valve member which pivots on an air gate valve pivot pin 55. Alternatively, the gate valve 50 could be some other type of valve such as a linearly moving valve. The valve 50 operates in the manner of a check valve to control the flow of gases through the air gate 49. Therefore, the valve 50 is positioned on the gate valve chamber side of the gate 49 and is resiliently urged to close the air gate 49 by an air gate valve spring 56 which is represented in FIG. 11 by an arrow 56. The spring 56 may be engaged between the valve pivot pin 55 and the wall 45 of the combustor unit 6. The spring constant of the spring 56 is relatively low; and, for the most part, the position of the gate valve 50 is controlled by the pressure differential acting thereon. Thus, when the pressure of the compressed air exceeds the pressure within the remainder of the combustor unit 6, the gate valve 50 opens to admit compressed air into the firing chamber 34. In some configurations of the combustor unit 6, it might be desirable to detect the position of the gate valve 50. Such position sensing would be employed to coordinate the injection of fuel and ignition thereof with the position of the gate valve. The position of the valve 50 can be sensed by optical means or electromechanical means (neither shown) such as an electrical contact cooperating with the shaft 55 of the valve 50.

During combustion of the fuel-air mixture in the firing chamber 34, the pressure of the combustion gases exceeds the pressure of the compressed air such that the gate valve 50 is tightly seated to prevent the injection of combustion gases into the compression module 5 or the compressor 8. When compressed air is received directly from a compression module 5, it is desirable to provide a compressed air chamber 57 between the module 5 and the air gate 49 to store the compressed air until pressure within the firing chamber 34 has dropped sufficiently to allow the gate valve 50 to open. When compressed air is received from a separate compressor 8, the compressed air chamber 57 is not required.

Figure 13:
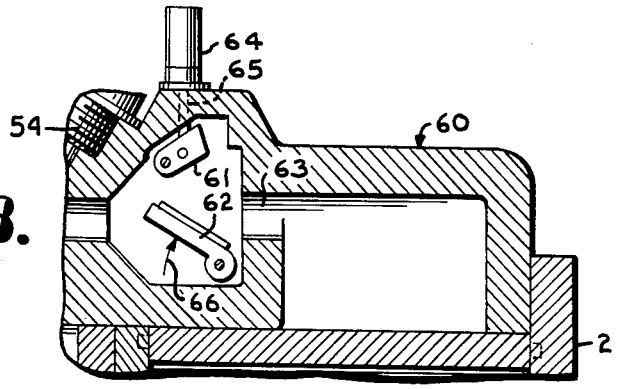
FIG. 13 is a fragmentary view similar to FIG. 11 and illustrates a combustor unit incorporating a solenoid operated compressed air gate valve.

Under some circumstances, it might be desirable to more closely control the entrance of compressed air into the firing chamber 34. Referring to FIG. 13, an embodiment of a combustor unit 60 is shown which includes a latch member 61 which controls the opening of a compressed air gate valve 62. The latch 61 is resiliently urged in the latched position and is configured such that the valve 62 snaps past the latch 61 in closing the compressed air gate 63 and is held in the seated position. A spring return solenoid 64 has a plunger 65 connected with the latch 61. When the solenoid 64 is activated, the latch 61 is drawn to an unlatched position which allows the gate valve 62 to be opened by the pressure of compressed air from a compression module 5 or compressor 8. The operation of the solenoid 64 is timed, as will be described hereinbelow, such that the solenoid is deactivated after a selected time interval thereby allowing the latch 61 to assume its latched position. When the pressure within the firing chamber is equalized by filling with compressed air, a spring 66 (represented by an arrow 66) causes the gate valve to close past the latch 61 and be held in a seated position thereby.

The diagram in FIG. 2 generally illustrates the operation of the engine 1. The air compressor 8 or compression module 5 is driven by the engine shaft 4 to provide compressed air by way of the gate valves 50 to the firing chambers 34. Fuel from a fuel tank 71 is provided to the firing chambers 34 by the fuel injectors 54 as timed by a fuel injector timer 72. Current from a high voltage source 73 is distributed to the spark plugs 47 by a spark plug timer 74 to ignite the fuel-air mixture within the firing chambers 34. The expanding gases of combustion are communicated to the combustion modules 3 to cause rotation of the rotors 15 thereby causing rotation of the engine shaft 4. If gate valve latches 61 are employed to control the positions of gate valves 62, the solenoids 64 which position the latches 61 are controlled by a solenoid timer 75.

The fuel injector timer 72, spark plug timer 74, and solenoid timer 75 are illustrated as being ultimately controlled by the position of the engine shaft 4. These timers may be any suitable type of individual or collective timers such as the type of electromechanical timers employed in conventional spark distributors or may be embodied as a digital computer which monitors and controls other functions of the engine 1 or a vehicle or system of which the engine 1 is a component. The engine shaft position may be sensed by conventional types of shaft encoders. In some respects, the control of the timing of engine functions by a computer is more versatile than electromechanical timing devices since the controller may be programmed to vary the timing of functions to optimize operation at varying temperatures and atmospheric pressures, engine temperatures, engine speeds, and the like.

Figure 7:
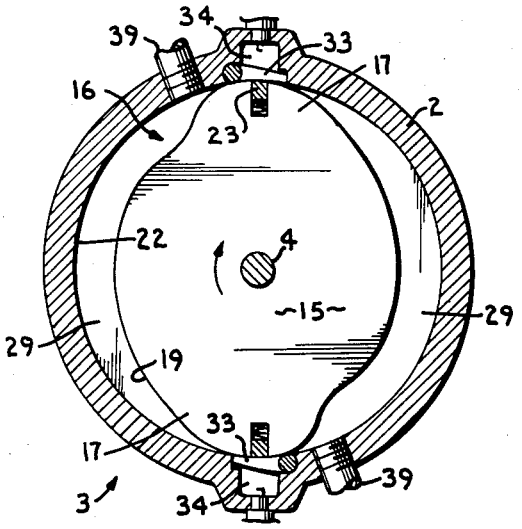
FIG. 7 is a transverse sectional view at a reduced scale of the two lobed combustion rotor at about the moment of ignition of the fuel mixture.
Figure 8:
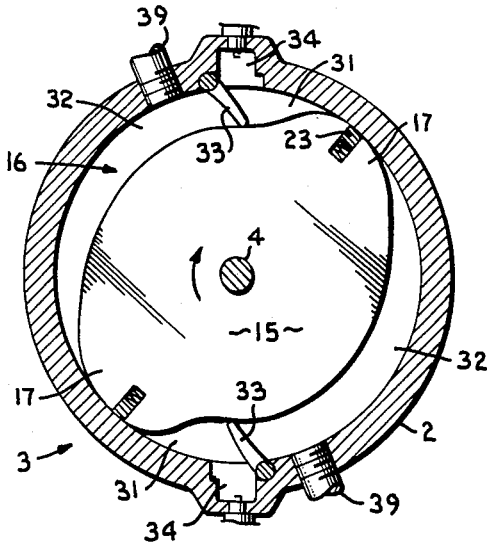
FIG. 8 is a view similar to FIG. 7 and shows the position of the combustion rotor just after ignition of the fuel mixture.

In FIG. 7 the rotor 15 is shown in a position just prior to ignition of the fuel-air mixture. The rotor 15 is just beginning to force the expanded combustion gases out the exhaust ports 39. At this position, the firing chamber valves 33 are forced closed by the lobes 17 of the rotor 15, and the firing chambers have received fresh charges of fuel and compressed air. It is preferred that at least two combustion modules 3 be positioned on the engine shaft 4 and rotationally phased about ninety degrees from one another. In this way the firing of the rotors is staggered and operation is smoother since the combustion pulses are distributed over the engine shaft rotation cycle. FIG. 8 shows the position of the rotor 15 after ignition of the mixture, and the firing chamber valves 33 have been forced into sealing contact with the rotor 15 by combustion pressures. At the same time, rotation of the rotor 15 causes the expulsion of the expended combustion gases from the previous combustion stroke out the exhaust ports 39.

Figure 9:
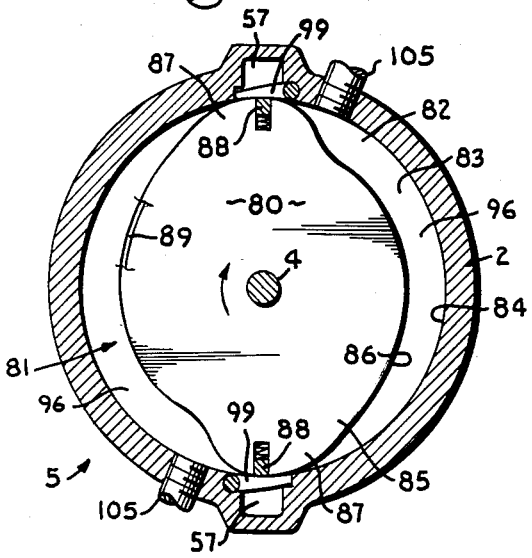
FIG. 9 is a view similar to FIG. 7 and shows an embodiment of a rotary compressor module with the compressor rotor at the end of the intake portion of the compression cycle.
Figure 10:
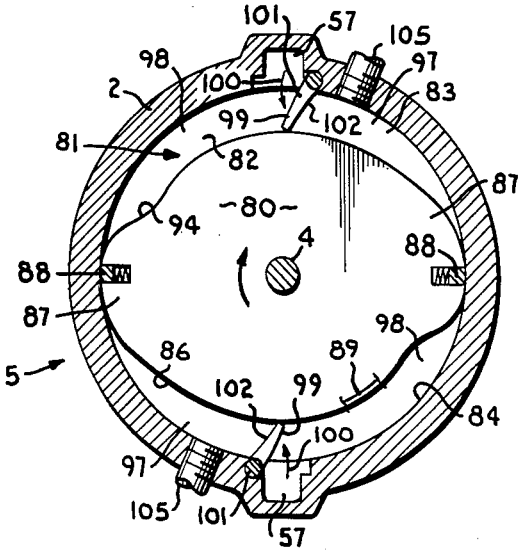
FIG. 10 is a view similar to FIG. 9 and shows the position of the compressor rotor about halfway through the compression portion of the compression cycle.

FIGS. 9 and 10 illustrate a rotary compressor module 5 which is suitable for use in the rotary engine 1. The compressor module 5 includes a compressor rotor 80 keyed or otherwise attached to the engine shaft 4 and positioned in a cylindrical compressor cavity 81. The compressor cavity 81 is separated from the combustion cavity 16 by a partition 82 which in some configurations of the engine may include air or water passages (not shown) for cooling the combustion module 6. The compressor cavity 81 includes a pair of opposed base surfaces 83 and a peripheral cylindrical surface 84. The rotor 80 has opposite end face for base surfaces 85 and a continuous peripheral surface 86. The compressor rotor 80 has two opposite lobes 87 having apex seals 88 similar to the seals 23 positioned therein for sealing contact with the cylindrical surface 84 of the compressor cavity 81. The end faces 85 of the rotor 80 are sealed against the base surfaces 83 of the compressor cavity 81 by end face seals 89 (only fragments of which are shown) which are similar to the end face seals 26 of the combustion rotor 15.

The illustrated compressor rotor 80 is similar in shape to the shape of the combustion rotor 15 except that the rotors 80 and 15 are substantially mirror images of one another. The combustion rotor 15 has depressions 91 (FIG. 3) in the peripheral surface 19 thereof on the trailing side (for the clockwise motion indicated) of the lobes 17 to control the position of the firing chamber valves 33 and the speed at which they are allowed to open relative to the rotational speed of the rotor 15. In contrast, the compressor rotor 80 has depressions 94 in the peripheral surface 86 on the leading side of the lobes 87 for a similar purpose as will be explained below.

The compressor rotor 80 forms crescent or C-shaped chambers 96 (FIG. 9) in the compressor cavity 81 which are sealingly divided into an intake chamber 97 and a compression chamber 98 (FIG. 10) by hinged compressed air chamber valves 99. The valves 99 control gas communication between the compressor cavity 81 and the compressed air chambers 57 of the combustor units 6 and are similar in many respects to the firing chamber valves 33 of the combustion module 3 except are oppositely hinged. The valves 99 are resiliently urged to opened positions by springs 100 (represented by arrows 100, FIG. 10) which act between the housing 2 and pivot shafts 101 of the valves 99. The surfaces 102 of the valves 99 on the compressor cavity side thereof are cylndrical and of the same radius as the cylindrical surface 84 of the cavity 81 and form a continuation thereof in the closed positions of the valves 99. The shape of the compressor rotor lobes 87 as determined by the depressions 94 therein control the speed at which the valves 99 are closed by rotation of the compressor rotor 80.

The intake chambers 97 receive air through air intake ports or inlets 105 as the rotor 80 rotates in a clockwise direction (as viewed in the figures) and forces the air into the compressed air chambers 57 of the combustor units 6 in timed relationship with the operation of the combustion module 3. The air inlets 105 may include conventional air filters (not shown). The valves 99 seal against the base surfaces 83 of the compressor cavity 81 and the peripheral surface 86 of the rotor 80. The angular relationship between the combustion rotor 15 and the compressor rotor 80 depends on factors of engine operation and would likely be about fifteen degrees with the combustion rotor 15 leading.

When the comressed air from the compression module 5 is fed directly to the combustor units 6, it is preferred that each combustion module 3 be paired with its own compression module 5 in order for proper timing of the compression cycle to occur. However, the compressed air can be diverted through a compressed air reservoir tank, as will be detailed hereinbelow, in which case only one compresson module 5 would be required if it could provide the necessary volume of compressed air. The capacity of the rotary compression module 5 can be increased by increasing the axial depths of the compressor cavity 81 and the rotor 80. Increases in capacity can also be accomplished by increasing the radius of the compressor cavity and rotor and by altering the peripheral contour of the compressor rotor 80. Alterations to the geometric parameters of the compression module 5 and combustor unit 6 can also affect the effective compression ratio of the engine 1 as might be required depending on the type of fuel employed.

Figure 6:
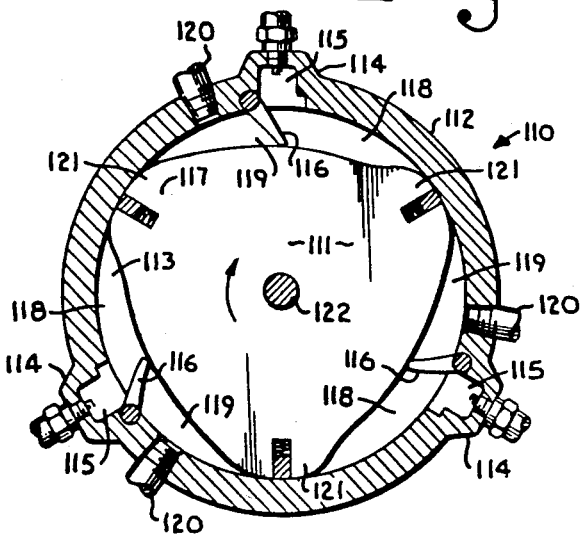
FIG. 6 is a transverse sectional view at a reduced scale of a three lobed embodiment of the combustion module.
Figure 5:
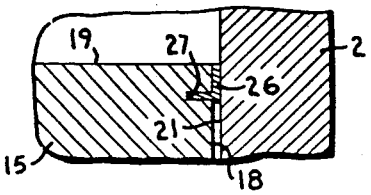
FIG. 5 is a greatly enlarged longitudinal sectional view taken on line 5—5 of FIG. 3 and illustrates further details of one of the rotor face seals.

FIG. 6 illustrates a modified combustion module 110 according to the present invention which employs a three lobed rotor 111. A housing 112 forms a cylindrical combustion cavity 113 in which the rotor 111 is sealingly positioned. Three combustor units 114 are spaced evenly about the combustion cavity 113, and each includes a firing chamber 115 in which a combustible mixture of fuel and compressed air is ignited to cause rotation of the rotor 111. The firing chambers 115 communicate with the combustion cavity 113 when respective firing chamber valves 116 are opened and forced into sealing contact with the periheral surface 117 of the rotor 111. The valve 116 divide crescent shaped volumes of the combustion cavity 113 which are not occupied by the rotor 111 into expansion chambers 118 and exhaust chambers 119 which communicate with exhaust ports 120.

The modified combustion rotor 111 has three lobes 121 which are evenly spaced thereabout. The rotor 111 is keyed to an engine shaft 122 and is operative to rotate same in response to the communication of expanding combustion gases from the firing chambers 115 into the expansion chambers 118. The modified combustion module 110 operates in substantially the same manner as the combustion module 3 except for the timing of the cycles to accommodate the increase in the number of firing cycles per revolution of the engine shaft 122. A compression module (not shown) for feeding compressed air directly to the combustor units 114 would be substantially similar to the combustion module except for analogous differences between the combustion module 3 and compression module 5 and a difference in timing. Alternatively, combustion and compression modules with rotors having a number of lobes greater than three could be embodied according to the present invention. However, there is a point of diminishing returns in increasing the number of rotor lobes and combustor units as far as engine simplicity and efficiency are concerned.

Figure 12:
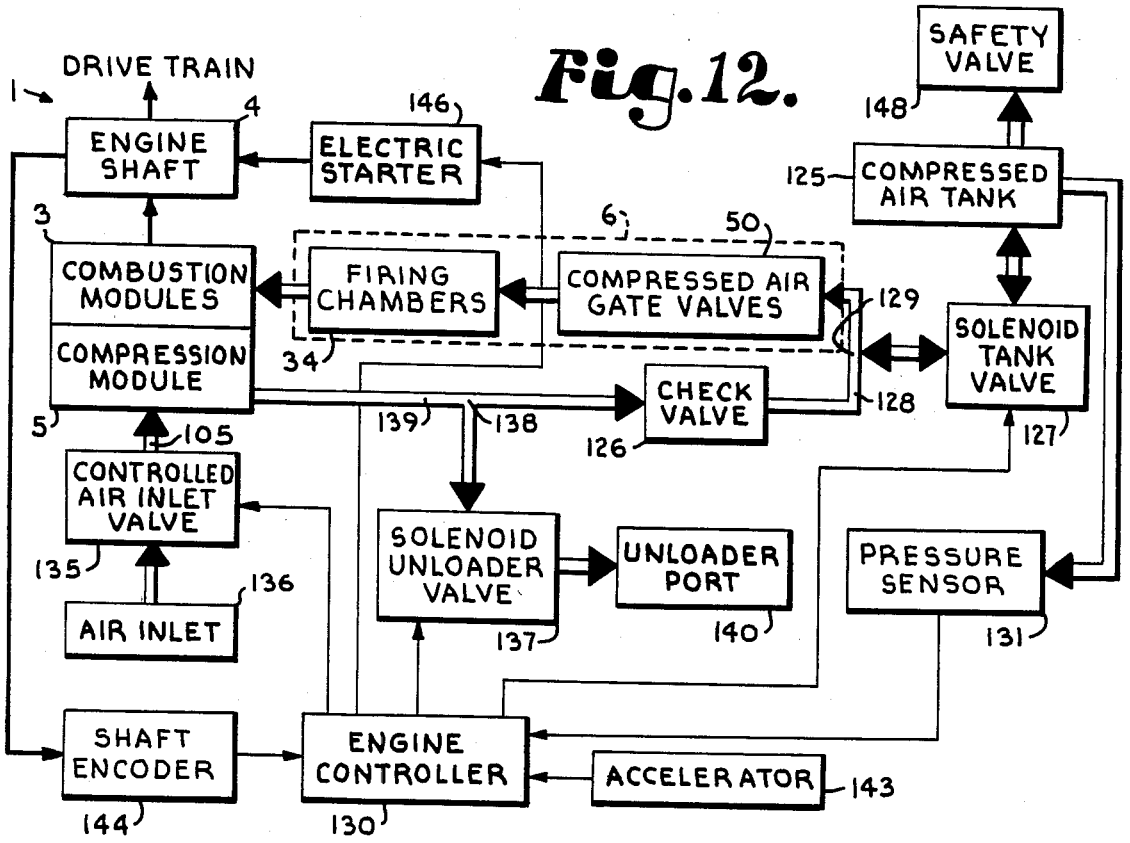
FIG. 12 is a block diagram illustrating a mode of operation of the rotary engine in which compressed air is stored in a reservoir tank.

Referring to FIG. 12, the engine 1 is shown diagrammatically with provisions for feeding compressed air indirectly form the compression module 5 to the firing chambers 34 of the combustion modules 3. In FIG. 12, double lines represent airflow, heavy lines represent rotational transfers, and normal weight single lines represent control signals. The compression module 5 is of such a capacity that it provides a greater volume of compressed air than is immediately required by the combustion modules 3. The excess compressed air is stored in a reservoir or compressed air tank 125. Between the compression module 5 and the tank 125 are a check valve 126 and a solenoid operated tank valve 127. An air line 128 between the check valve 126 and the combustor units 6 has a T-connection 129 such that compressed air can flow into the combustor units through the gate valves 50 and also into the tank 125 when the tank valve 127 is open.

The solenoid which controls the position of the tank valve 127 is controlled by an engine controller 130 which may be a digital computer. Such types of computers are currently in use for controlling the operation of conventional automobile engines and other types of engines. Engine control computers are programmed to sense certain engine parameters and to control selected engine operation functions in response thereto. In addition to controlling the compressed air system shown in FIG., 12, the controller 130 may incorporate the functions of the spark plug timer 74, the fuel injection timer 72, and the gate valve latch solenoid timer 75 shown in FIG. 2. In the illustrated engine 1, the controller 130 senses the air pressure within the tank 125 by means of a pressure sensor 131 and controls the state of the valve 127 accordingly.

The filling of the tank 125 with air and the maintenance of the pressure therein is coordinated with controlling the influx of air through the air intakes 105 of the compression module 5. A controlled air inlet valve 135 is positioned between an air inlet 136 and the air intakes 105 and connected to the engine controller 130. The valve 135 is preferably a modulating throttle valve. Additionally, a solenoid operated unloader valve 137 is connected by a T-connection 138 to the air line 139 which feeds compressed air through the check valve 126 to the tank 125 and the combustor units 6. The unloader valve 137 is connected to and controlled by the engine controller 130 to direct air out through an unloader port 140 under certain conditions. By these means, the feeding of compressed air to the combustion module 3 and the tank 125 can be controlled according to engine demand and the pressure state within the tank 125. The engine demands are sensed in part by the relative rotation speed of the engine shaft 4 and by the position of an accelerator 143. The shaft speed may be sensed by a binary shaft encoder 144 which may also sense the angular position of the shaft 4.

When the accelerator 143 is pressed for acceleration, the unloader valve 137 is closed while the air inlet valve 135 is opened to maximum to provide a maximum amount of compressed air to the combustor units 6. When a steady speed is reached, the valves 135 and 137 are operated cooperatively to maintain the current engine speed, and the tank valve 127 is operated in such a manner as to maintain a selected level of pressure within the tank 125. When the accelerator 143 is released for deceleration and the engine shaft is slowing down, the unloader valve 137 may be opened to exhaust excess air through the unloader port 140 if the tank 125 has sufficient pressure therein for four starts, for example. During starting of the engine 1 by rotation of the engine shaft 4 by an electric starter 146, the unloader valve 137 may be opened to decrease the starting load until the engine 1 starts. During starting the compressed air for firing the engine is provided by the tank 125.

The storage of compressed air in the tank 125 also provides a means for starting the engine 1 by injecting compressed air into the combustion cavity 16 to cause rotation of the combustion rotor 15. During a compressed air start, the unloader valve 137 is opened to unload the compression module 5, and the tank valve 127 is opened to provide compressed air from the tank 125 to the combustion module 3. The provision of fuel to the fuel injectors 54 and high voltage to the spark plugs 47 is suspended until the engine shaft 4 reaches a selected speed. If the compressed air in the tank 125 is exhausted before the engine 1 can be started, the electric starter 146 is activated to rotate the engine shaft 4, and the valves 137 and 127 are closed to provide compressed air directly from the compression module 5 to the combustor units 6. The operation of the various components during starting are preferably coordinated by the engine controller 130.

The manner of handling compressed air in the engine 1 provides a means for engine braking to assist conventional wheel brakes in decelerating a vehicle employing the engine 1. The compression of air into the tank 125 would apply a load to the engine shaft 4 thereby helping to decelerate same. The tank 125 is provided with a safety valve 148 to prevent the tank from being overpressurized, whether compressed air engine braking is incorporated or not. As the pressure in the tank 125 rises to a selected level, the valve 148 opens to relieve the pressure. It is preferable that the gate valve latches 61 and solenoids 64 be provided in association with the gate valves 50 if engine braking is employed to control the amount of compressed air being sent to the combustor units 6 as the engine is decelerated.

It is envisioned that the engine 1 could be operated in a non-idle mode under certain circumstances to avoid wasting fuel. When the accelerator 143 is released and the speed of the engine shaft 4 has decreased to a steady rate the provision of fuel and spark to the combustor units 6 is suspended to allow the engine to freewheel to a stop, provided that sufficient pressure is available in the tank 125 to restart the engine. When the accelerator is again depressed, compressed air from the tank 125 is employed to restart the engine along with fuel and spark when a high enough engine shaft speed has been achieved. The non-idle mode would be entered at a selected time after the accelerator 143 is released as determined by the engine controller 130 to avoid the nuisance of engine shutdown for short periods of time when the accelerator is released such as occur in normal city driving. Also if vehicle facilities such as active air conditioning were occurring, the non-idle mode would not be entered. However, in stopped traffic situations which often occur during urban rush hour, such a non-idle mode of operation would save substantial amounts of fuel.

With the addition of a secondary high pressure compressor, pressure sensors, and solenoid valves (not shown), energy which would otherwise be wasted can be recovered in the form of compressed air during down hill motion of a vehicle with the engine 1, during deceleration, or during idling. The compressed air would be compressed to a much higher pressure than the air in the tank 125 and would thereafter be injected directly into the combustion modules without fuel or spark to turn the rotors therein. The controller 130 would be programmed to cause the engine 1 to use the high pressure air for as long as possible before injecting fuel and igniting same to thereby conserve fuel.

The engine 1, therefore, incorporates most of the advantages of conventional rotary engines such as greater inherent efficiency, decreased vibration, and simplicity of design. In addition, the engine 1 provides numerous additional benefits because of the external compression of air and the storage of same. The engine 1 is intended for application to ground vehicles and additionally to boats, aircraft, and fixed applications such as in pumping and electrical power generation. Therefore, the exact combination of features described herein to be applied to an engine 1 would depend upon the application of the engine.

It is to be understood that while certain forms of the present invention have been illustrated and described herein, it is not to be limited to the specific forms or arrangement of parts described and shown.

What is claimed and desired to be secured by Letters Patent is as follows:

1. A non-idle method of operating an internal combustion engine including a rotary engine shaft; fuel supply means to supply fuel to said engine to cause the operation of said engine; an air compressor driven by rotation of said shaft and communicating with said engine to supply compressed air thereto for mixing with fuel to form a combustible mixture; spark means associated with said engine and controllable to cause the ignition of a fuel-air mixture therein to cause the rotation of said shaft; a compressed air reservoir storing excess compressed air from said compressor; an air valve connecting said reservoir with said compressor and said engine to control the flow of compressed air from said compressor to said reservoir and from said reservoir to said engine; an accelerator movable to operatively control the rotational speed of said engine shaft; shaft encoder means generating a shaft speed signal indicative of the rotational speed of said engine shaft; and an engine controller operatively interconnected with said fuel supply means, said spark means, said valve, said accelerator, and said shaft encoder, said method comprising the steps of:

(a) running said engine;

(b) storing excess compressed air in said reservoir during the running of said engine;

(c) sensing the rotational speed of said engine shaft;

(d) sensing the position of said accelerator;

(e) upon sensing that said accelerator is on an idle speed position and that said engine shaft has slowed to an idle rotational speed, controlling said fuel supply means and said spark means by said engine controller to be inhibited to cause the shutdown of said engine; and (f) upon sensing that said accelerator is in a position indicating a demand to an increase in engine shaft speed, controlling, by said engine controller, said air valve to cause the communication of compressed air to said engine to cause the rotation of said engine shaft and controlling said fuel supply means and said spark means to be reactivated to thereby restart said engine.

2. A method as set forth in claim 1 wherein said engine includes a check valve positioned between said compressor and said air valve, an unloader valve connected between said compressor and said check valve, and an unloader port connected to said unloader valve, said unloader valve being connected to said engine controller, and said method including the steps of:

(a) controlling said unloader valve to open by said engine controller to exhaust air compressed by said compressor through said unloader port to decrease the back pressure on said compressor during the communication of compressed air from said reservoir to said engine during starting; and (b) controlling said unloader valve to close by said engine controller upon sensing that the rotational speed of said engine shaft has increased thereby indicating that said engine has started.

3. A method as set forth in claim 1 wherein said engine includes an air pressure sensor associated with said reservoir and connected to said engine controller and engine starter means engageable with said engine shaft and selectively operable to cause the rotation of said shaft to start said engine, and said method includes the steps of:

(a) sensing the pressure in said reservoir; and (b) upon sensing that the pressure in said reservoir is less than a selected engine starting pressure during engine starting, controlling said engine starter means to engage said engine shaft and operate to rotate said shaft to cause the starting of said engine.

4. An internal combustion engine capable of operation in a non-idle mode comprising:

(a) an engine housing forming a combustion cavity;

(b) an engine shaft rotatably mounted on said housing and extending through said cavity;

(c) an air compressor operatively connected to said shaft and compressing air upon the rotation of said shaft;

(d) a compressed air reservoir communicating with said compressor and storing excess compressed air from said compressor;

(e) an air valve connecting said reservoir with said compressor and said engine to control the flow of compressed air from said compressor to said reservoir and from said reservoir to said engine;

(f) fuel supply means operative to supply a combustible fuel, said fuel supply means cooperating with said compressor to form a fuel-air mixture which is cyclically communicated to said engine cavity;

(g) timed igniter means operative to ignite said mixture;

(h) volume element means movably positioned in said cavity and operatively connected to said shaft, said volume element means cyclically increasing the working volume of said cavity thereby rotating said shaft in response to the ignition of said mixture in said cavity and decreasing said working volume to exhaust combusted gases from said cavity;

(i) an accelerator movable to operatively control the rotational speed of said engine shaft;

(j) shaft encoder means generating a shaft speed signal indicative of the rotational speed of said engine shaft; and (k) engine controller means operatively interconnected with said fuel supply means, said igniter means, said valve, said accelerator, and said shaft encoder; whereby upon sensing that said accelerator is in an idle speed position and that said engine shaft has slowed to an idle rotational speed, said engine controller means controls said fuel supply means and said igniter means to be inhibited to cause the shutdown of said engine and whereby upon sensing that said accelerator is in a position indicating a demand for an increase in engine shaft speed, said controller means controls said air valve to cause the communication of compressed air to said engine to rotate said engine shaft and controls said fuel supply means and said igniter means to be reactivated to thereby restart said engine.

5. An engine as set forth in claim 4 including:

(a) a check valve positioned between said compressor and said air valve;

(b) an unloader valve connected between said compressor and said check valve;

(c) an unloader port connected to said unloader valve, said unloader valve being connected to said engine controller means;

(d) said engine controller means controlling said unloader valve to open to exhaust air compressed by said compressor through said unloader port to decrease the back pressure on said compressor during the communication of compressed air from said reservoir to said engine during starting; and (e) said controller means controlling said unloader valve to close upon sensing that the rotational speed of said engine shaft has increased thereby indicating that said engine has started.

6. An engine as set forth in claim 4 including:

(a) an air pressure sensor associated with said reservoir and connected to said engine controller means;

(b) engine starter means engageable with said engine shaft and selectively operable to cause the rotation of said shaft to start said engine; and (c) said controller means controlling said engine starter means to engage said engine shaft and operate to rotate said shaft to cause the starting of said engine upon sensing that the pressure in said reservoir is less than a selected engine starting pressure during engine starting.

7. An engine as set forth in claim 4 wherein:

(a) said volume element means is a combustion rotor having at least two lobes, said combustion rotor being keyed to said engine shaft.

8. An engine as set forth in claim 4 wherein:

(a) said air compressor is a rotary air compressor including a lobed compressor rotor; and (b) said compressor rotor is keyed to said engine shaft.

9. An engine as set forth in claim 4 wherein said engine includes a combustor unit cooperating with said compressor and said fuel supply means to form a fuel-air mixture and having said igniter means positioned therein to ignite said mixture within said combustor unit, each combustor unit further including:

(a) a firing chamber communicating with said combustion cavity and communicating with said compressor means through a compressed air gate;

(b) a compressed air gate valve member positioned in said firing chamber and being resiliently urged to close said compressed air gate;

(c) said gate valve member being opened by the pressure of said compressed air to admit said air into said firing chamber at substantially the same time that fuel from said fuel supply means is admitted into said firing chamber;

(d) said gate valve member being resiliently urged to close said gate upon the filling of said firing chamber with the mixture of fuel and compressed air; and (e) said gate valve member being positively seated to close said gate by combustion pressure upon the activation of said igniter means.

10. An engine as set forth in claim 9 including:

(a) a gate valve latch cooperating with said gate valve member to lock same in a seated position closing said compressed air gate in a latched position of said latch and to release said gate valve member in an unlatched position, said latch being resiliently urged to said latched position whereby said gate valve member upon closing snaps past said latch; and (b) a timed solenoid having a plunger connected to said latch and operative to move said latch to said unlatched position upon being activated.

11. An engine as set forth in claim 9 including:

(a) a hinged firing chamber valve positioned between said firing chamber and said combustion cavity and resiliently urged to block communication therebetween, said firing chamber valve being opened by combustion pressure upon the ignition of said mixture of fuel and air to thereby communicate said expanding gases of combustion to said combustion cavity.

* * * * *